US010823177B2

(12) United States Patent
Sheth et al.

(10) Patent No.: US 10,823,177 B2
(45) Date of Patent: Nov. 3, 2020

(54) SYSTEMS AND METHODS FOR SENSING PARAMETERS IN AN ESP USING MULTIPLE MEMS SENSORS

(71) Applicants: Ketankumar Sheth, Tulsa, OK (US); Michael A. Forsberg, Claremore, OK (US)

(72) Inventors: Ketankumar Sheth, Tulsa, OK (US); Michael A. Forsberg, Claremore, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1114 days.

(21) Appl. No.: 15/239,721

(22) Filed: Aug. 17, 2016

(65) Prior Publication Data

US 2018/0051700 A1 Feb. 22, 2018

(51) Int. Cl.

| | |
|---|---|
| ***E21B 47/008*** | (2012.01) |
| ***E21B 43/12*** | (2006.01) |
| ***F04D 15/00*** | (2006.01) |
| ***E21B 43/38*** | (2006.01) |
| ***F04D 7/02*** | (2006.01) |
| ***F04D 13/06*** | (2006.01) |
| ***F04D 13/10*** | (2006.01) |
| ***F04D 29/22*** | (2006.01) |
| ***F04D 29/42*** | (2006.01) |
| ***F04D 29/44*** | (2006.01) |
| *F04D 1/06* | (2006.01) |

(52) U.S. Cl.

CPC ..... *F04D 15/0088* (2013.01); *E21B 43/128* (2013.01); *E21B 43/38* (2013.01); *E21B 47/008* (2020.05); *F04D 7/02* (2013.01); *F04D 13/0693* (2013.01); *F04D 13/10* (2013.01); *F04D 29/22* (2013.01); *F04D 29/426* (2013.01); *F04D 29/445* (2013.01); *F04D 1/06* (2013.01); *F05D 2270/334* (2013.01)

(58) Field of Classification Search

CPC ..... E21B 43/128; E21B 47/0007

See application file for complete search history.

(56) References Cited

U.S. PATENT DOCUMENTS 7,434,457 B2 * 10/2008 Goodwin ..... E21B 49/08 361/160

8,141,646 B2 3/2012 Alien (Continued)

*Primary Examiner* — Shane Bomar

(74) *Attorney, Agent, or Firm* — Sprinkle IP Law Group

(57) ABSTRACT

Systems and methods for distributed downhole sensing of operating parameters in an ESP utilizing MEMS sensors. In one embodiment, an ESP is installed in a well. The ESP has a pump, a gas separator, a seal section and a motor. Multiple MEMS sensors are positioned within one or more of the ESP components. Each of the MEMS sensors has a sensor component and on-board circuitry that are formed on a substrate. Each MEMS sensor's sensor component senses a corresponding operating parameter and provides sensed information to the on-board circuitry, which processes the received sensor signal as needed and provides the processed information at an output of the MEMS sensor. The outputs of the different MEMS sensors can be networked together, and the sensor information for the different operating parameters can be communicated to equipment at the surface of the well via a common electrical line.

20 Claims, 7 Drawing Sheets

(56) References Cited

U.S. PATENT DOCUMENTS

| | | | | |
|---|---|---|---|---|
| 8,436,743 | B2 | 5/2013 | Auzerais | |
| 9,057,256 | B2 | 6/2015 | Ige | |
| 2009/0033516 | A1* | 2/2009 | Alteirac | E21B 47/12 340/853.2 |
| 2009/0044953 | A1* | 2/2009 | Sheth | E21B 43/128 166/369 |
| 2011/0002795 | A1* | 1/2011 | Brookbank | F04B 47/06 417/63 |
| 2011/0067882 | A1 | 3/2011 | Yeriazarian | |
| 2011/0186290 | A1* | 8/2011 | Roddy | E21B 47/0005 166/253.1 |
| 2013/0213647 | A1 | 8/2013 | Roddy | |
| 2013/0272898 | A1* | 10/2013 | Toh | F04D 15/00 417/44.1 |
| 2014/0111349 | A1 | 4/2014 | Roberson | |
| 2014/0158347 | A1* | 6/2014 | Fielder | E21B 47/0007 166/250.01 |
| 2014/0262244 | A1 | 9/2014 | Gill | |
| 2014/0305636 | A1* | 10/2014 | Paulet | E21B 43/121 166/250.01 |
| 2014/0367092 | A1 | 12/2014 | Roberson | |
| 2016/0222984 | A1* | 8/2016 | Lam | F04D 13/10 |
| 2018/0195373 | A1* | 7/2018 | Bell | E21B 43/128 |

* cited by examiner

SYSTEMS AND METHODS FOR SENSING PARAMETERS IN AN ESP USING MULTIPLE MEMS SENSORS

BACKGROUND

Field of the Invention

The invention relates generally to artificial lift systems, and more specifically to systems and methods for sensing various parameters at multiple points in an electric submersible pump (ESP) using MEMS (micro-electro-mechanical systems) sensors.

Related Art

In the various phases of petroleum production (including drilling and completion of wells and subsequent production from the wells), it is desirable to have information about conditions relating to the wells and the equipment that is used therein. For example, it may be desirable to be aware of well conditions in the vicinity of an ESP. Downhole gauge packages are commonly used for this purpose. Gauge packages typically enclose sensors for the desired parameters in a housing that can be positioned at a desired location in the well. One type of gauge package is designed to be connected to the lower end of an ESP motor to monitor operating conditions of the ESP. The sensor data may be stored within the gauge package for later retrieval, or it may be connected to an electrical line that allows the data to be communicated to a user or to monitoring equipment at the surface of the well. One of the problems with such gauge packages is that they sense conditions only at the location of the gauge package (e.g. at the bottom of the ESP motor). The expense and physical configurations of gauge packages usually make them impractical for sensing conditions at multiple points.

More recently, techniques have been developed to enable more distributed sensing of well conditions. For instance, an optical fiber may incorporate multiple Bragg gratings along the length of the fiber. Light that is introduced to the fiber and is reflected by the Bragg gratings may be analyzed to determine conditions affecting the fiber at the positions of the gratings. In one application, fiber Bragg gratings may be attached to wellbore tubulars or casings to enable strain measurements to be made along the lengths of the tubular or casings. In another application, optical fiber sensors may be positioned within components of an ESP to determine operating conditions of the ESP. While these types of sensors enable sensing of parameters over multiple, distributed locations, they have other drawbacks. For instance, fiber optic sensing systems may be limited in the types of parameters that can be sensed. Additionally, fiber optic systems are sophisticated, expensive and more fragile than gauge packages. Still further, a typical fiber optic sensing system only senses one type of parameter (e.g., pressure, temperature, strain, etc.) per fiber, so additional types of parameters require additional, dedicated fibers and corresponding components to inject optical signals into the fiber and to interpret reflected signals.

It would therefore be desirable to provide systems and methods for sensing conditions associated with the operation of downhole equipment that reduce or eliminate some of the issues described above.

SUMMARY OF THE INVENTION

In light of the disadvantages of conventional sensing systems, it would be desirable to provide systems and methods for sensing conditions associated with the operation of downhole equipment that reduce or eliminate some of these disadvantages. This disclosure is directed to systems and methods for distributed downhole sensing that utilize MEMS sensors to achieve small-footprint, low-cost sensing of various parameters in an ESP system.

One embodiment is an ESP system which is installed in a well. The ESP system has a sensing system that includes multiple MEMS sensors. The ESP system has at least a pump, a seal and a motor which is coupled to the pump and is configured to drive the pump. The ESP system may also include a seal section, a gas separator and other components. Each of the MEMS sensors has a substrate with a sensor component and on-board circuitry that are formed on the substrate. The MEMS sensors are small enough that they can be easily positioned in various locations within the ESP system to sense various different operating parameters. Each MEMS sensor's sensor component senses a corresponding operating parameter and provides sensed information to the on-board circuitry. The on-board circuitry processes the received sensor signal as needed (e.g., digitizing or analyzing the signal) and provides the processed information at an output of the MEMS sensor. The outputs of the different MEMS sensors can be networked together in various configurations, and the information produced by the different MEMS sensors can be provided at a common output of the ESP system, from which the information can be communicated to equipment at the surface of the well. The consolidated sensor information can be communicated via one or more potentially dedicated electrical lines, or via conductors of the power ESP system's power cable.

Alternative embodiments may include individual components of the ESP system. The ESP system may include, for example, a motor, a seal section, a gas separator and a pump. In one embodiment, the motor may include MEMS sensors between the stator and housing to sense temperature and/or pressure, or in the stator slots to sense the temperature of the stator windings. In another embodiment, a seal section may include MEMS sensors, for instance, within the expansion chambers to sense temperature and/or pressure. In another embodiment, the gas separator may include MEMS sensors between a liner and a housing of the gas separator to sense temperature and/or pressure, at the input of the gas separator to sense fluid composition, and so on. In another embodiment, the pump may have MEMS sensors positioned at the thrust bearings to sense loading on the impellers, within the diffuser chambers to sense temperature and/or pressure, between the housing and outer diffuser walls to sense temperature and/or pressure. Any of the ESP components may include MEMS sensors proximate to the radial (shaft) bearings to sense vibration of the shaft through the respective components, or positioned at the interiors or exteriors of the respective ESP components to sense temperature and/or pressure.

Yet another embodiment comprises a method for sensing operating parameters of an ESP system. In this method, an ESP system includes one or more ESP components such as a pump, a motor, a seal section, or a gas separator. Multiple MEMS sensors, each having a substrate with a sensor component and on-board circuitry, are positioned in the ESP components. The ESP system is operated, and the MEMS sensors are used to sense corresponding operating parameters of the respective ESP components. In each MEMS sensor, the on-board circuitry receives a sensor signal from the sensor component, processes the signal, and provides sensed information at an output of the MEMS sensor.

The outputs of the different MEMS sensors may be consolidated at the ESP system before being communicated to equipment at the surface of the well. The MEMS sensor outputs may be combined and communicated on a common electrical line even though the different sensors are configured to sense different operating parameters. The MEMS sensor information may be communicated, for example, via dedicated line or via conductors of the power cable.

Numerous other embodiments are also possible.

BRIEF DESCRIPTION OF THE DRAWINGS

Other objects and advantages of the invention may become apparent upon reading the following detailed description and upon reference to the accompanying drawings. It should be noted that the features illustrated in the drawings are not necessarily drawn to scale.

Figure 1:
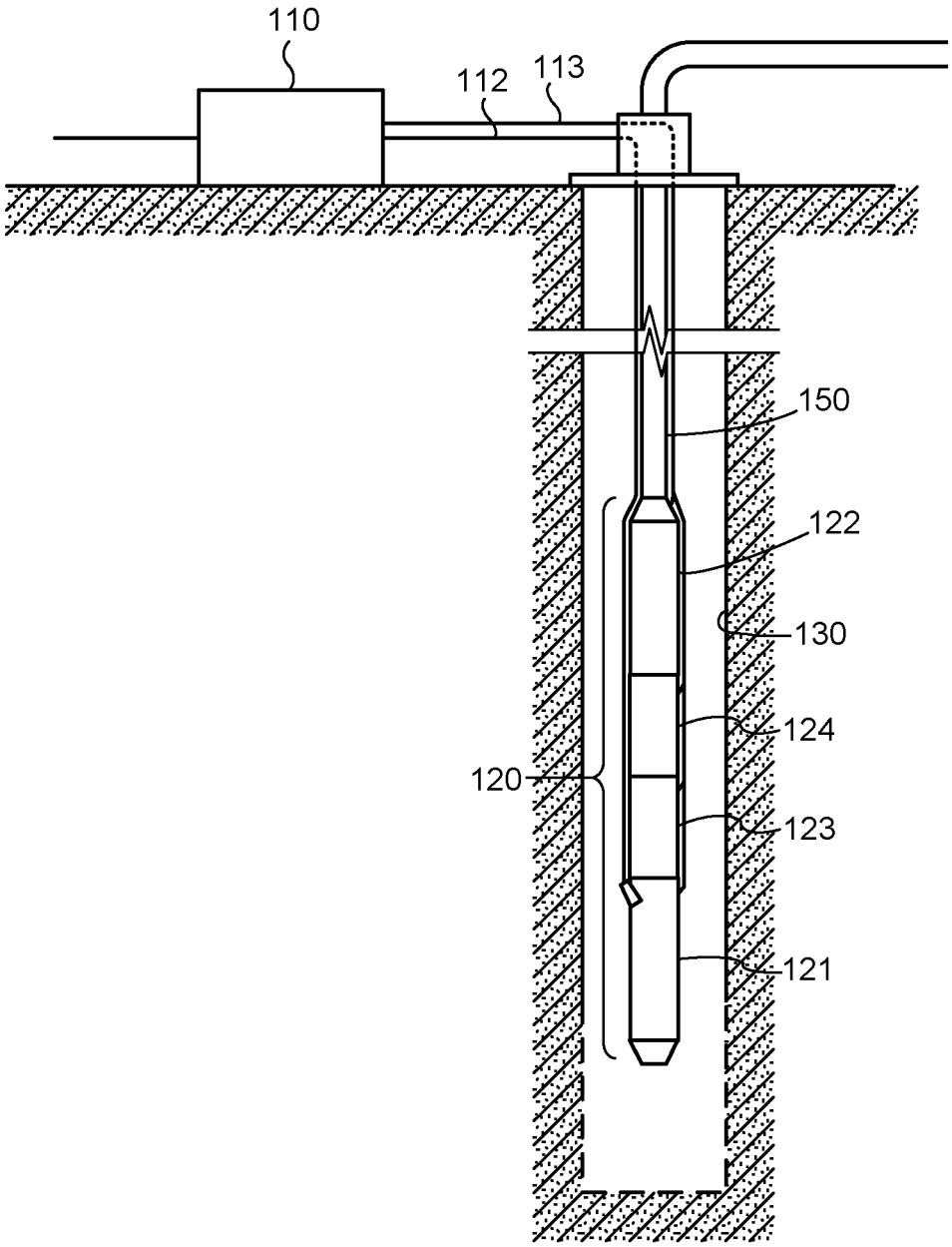
FIG. 1 is a diagram illustrating an exemplary ESP system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF PREFERRED EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for sensing parameters of downhole equipment such as ESP's using MEMS sensor systems.

In one embodiment, an artificial lift system is installed in a well. The artificial lift system uses an ESP that includes a pump, a gas separator, a seal and a motor. Each of these components incorporates MEMS sensors at various points which may be both internal and external to the components. The MEMS sensors produce electrical output signals that can be conveyed to surface components of the artificial lift system. For example, the MEMS sensor outputs can be provided to a transceiver in the ESP, which can then transmit the sensor data to the surface equipment. The MEMS sensors may simply output their respective sensor signals, or they may process the signals in some manner before providing a corresponding output. The MEMS sensors may be configured to sense a variety of different parameters, and the sensor data corresponding to these different parameters may be transmitted to the surface using a common transmission line. The sensor data may also be communicated to the surface over the conductors of the power cable in a comms-on system.

Referring to FIG. 1, a diagram illustrating an exemplary pump system in accordance with one embodiment of the present invention is shown. A wellbore 130 is drilled into an oil-bearing geological structure and is cased. The casing within wellbore 130 is perforated in a producing region of the well to allow oil to flow from the formation into the well. ESP 120 is positioned in the producing region of the well. ESP 120 is coupled to production tubing 150, through which the system pumps oil out of the well. A control system 110 is positioned at the surface of the well. Control system 110 is coupled to ESP 120 by power cable 112 and a set of electrical data lines 113 that may carry various types of sensed data and control information between the downhole ESP and the surface control equipment. Power cable 112 and electrical lines 113 run down the wellbore along tubing string 150.

ESP 120 includes an electric motor section 121 which is coupled to a pump section 122 through a seal 123 and a gas separator 124. ESP 120 may include various other components as well (e.g., a gauge package) which will not be described in detail here because they are well known in the art and are not important to a discussion of the invention. Motor section 121 receives power from control system 110 which runs the motor. The motor is coupled to a shaft that extends through seal 123, gas separator 124 and pump 122. This shaft may be formed by interconnected shaft components of the motor, seal, gas separator and pump.

There are a number of reasons that it may be desirable to monitor operating parameters (e.g., temperature, pressure, vibration, viscosity, corrosion and sound for flow conditions, oil conditions and properties, etc.) associated with an artificial lift system. For example, these parameters may be useful in the efficient control of the motor. Further, because of the high cost of installing and maintaining artificial lift systems, it is important to monitor conditions that may affect the reliability of the system. For instance, one of the operating conditions that is very important in assessing the health of an ESP is the temperature of the ESP. It may be desirable to monitor the temperature within each of the different components of the ESP (e.g., the motor, seal, gas separator and pump), and at various locations within each of these components.

It may be desirable to monitor other parameters within or around the ESP as well. For example, it may be desirable to monitor pressures at locations such as the pump intake and output, or between impellers/diffusers and the pump housing. It may also be useful to monitor vibration at various locations, such as at the bearings between the shaft and other components within the ESP. Still other parameters, including vibration, strain, fluid composition (gas/liquid ratio), flow rate and others may provide information about the system that allows it to be operated in a more efficient, reliable manner.

Embodiments of the present invention use MEMS sensors to enable the sensing of parameters at multiple locations within the artificial lift system. The use of MEMS sensors facilitates the sensing of different types of parameters for a number of reasons. For instance, the different types of MEMS sensors include on-board electronic circuitry that can allow them to be coupled to a common communication network. By comparison, in a fiber optic sensing system, each of the sensors incorporated into the optical fiber normally senses the same parameter. If different parameters need to be sensed in a fiber optic sensing sys, a different optical fiber is typically provided for each type of parameter, and a different surface transmitter/receiver unit is necessary to inject optical into the fiber and to interpret the reflection of the optical signals within the fiber.

Figure 2:
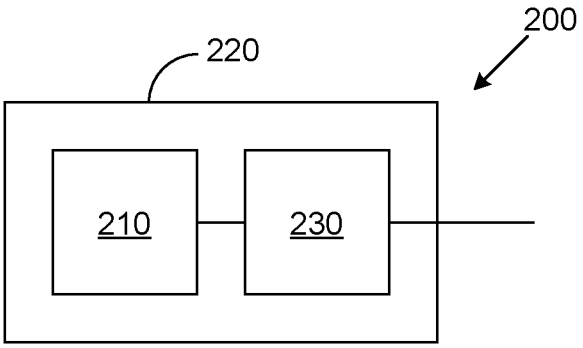
FIG. 2 is a diagram illustrating the general structure of an exemplary MEMS sensor.

Referring to FIG. 2, the general structure of an exemplary MEMS sensor is shown. In this example, MEMS sensor 200 includes a sensor 210 that is formed on a substrate 220. Sensor 210 may include miniaturized mechanical or electromechanical sensing structures. Sensor 210 is coupled to miniaturized circuitry 230, which is also formed on substrate 220. These components are typically between 0.001 and 0.1 mm and the MEMS sensors are typically less than 1 mm in size, which enables placement of the MEMS sensors in locations within the ESP. Circuitry 230 is configured to provide a signal from sensor 210 at an output. Circuitry may be configured to perform on-board processing of the signals received from sensor 210 and to provide the processed signals as an output, or it may simply pass the signals to the MEMS sensor's output. For instance, sensor 210 may provide an analog signal that is converted by on-board circuitry 230 to a digital signal that can be more easily communicated to the surface equipment, possibly through a common transceiver in the ESP, or directly to the surface equipment. Circuitry 230 may also perform pre-processing or various types of analyses on the signal received from sensor 210.

The MEMS sensors may be coupled together so that the outputs of the sensors can be conveyed to the surface equipment over a common electrical line or transmission channel. Similarly, a common electrical line can be used to convey data from the surface equipment to the MEMS sensors. The common electrical line may be a dedicated electrical line, one or more conductors of the power cable (a comms-on system), or any other suitable channel for electrical communications. Data can alternatively be communicated between the MEMS sensors and the surface equipment on multiple lines, but the use of fewer lines or common lines can allow the system to be less expensive than other sensing systems, such as fiber optic systems, in which multiple different communication lines would be necessary to enable the use of multiple sensor types (i.e., sensors that sense different parameters).

Figure 3A:
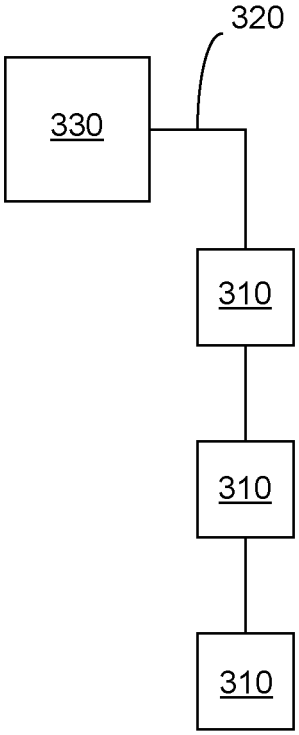
FIGS. 3A-3D are diagrams illustrating general configurations of MEMS sensors that are possible in exemplary embodiments.

The different MEMS sensors may be networked together in a variety of different ways. Examples of various configurations are illustrated in the diagrams of FIGS. 3A-3D to illustrate some of the ways in which the MEMS sensors can be networked together. Referring to FIG. 3A, multiple MEMS sensors 310 are serially connected to each other. The first of the MEMS sensors is coupled by an electrical line 320 to surface equipment 330, which may include transceivers, signal processors, displays, i/o devices, or any other necessary components. In this configuration, the circuitry of each MEMS sensor may be configured to pass through the data of the other MEMS sensors, or it may consolidate that data with its own data before communicating the data to the surface equipment.

Figure 3B:
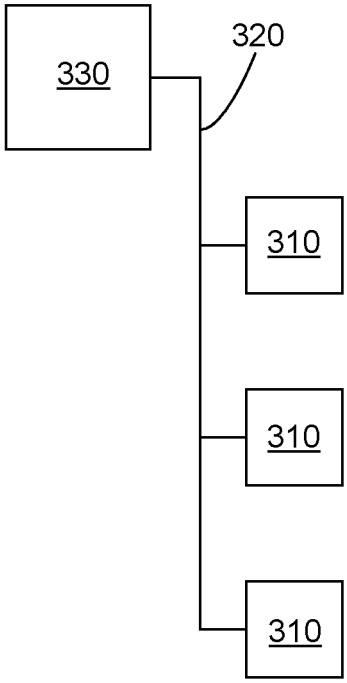

FIG. 3B illustrates a configuration in which each of the MEMS sensors is directly connected to common electrical line 320. The circuitry of each MEMS sensor may be configured to share the common line (e.g., data may be time-multiplexed on the line), or it may be configured to communicate with the surface equipment when prompted by the surface equipment.

Figure 3C:
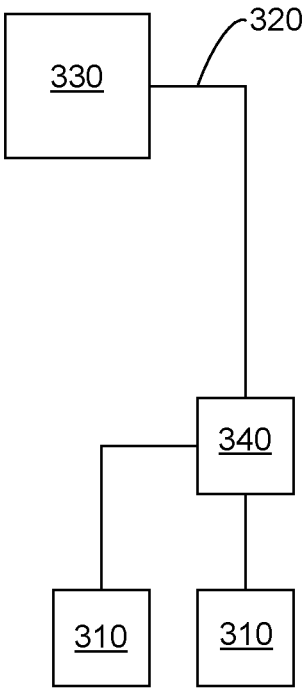

FIG. 3C depicts another possible configuration in which MEMS sensors 310 are coupled to circuitry 340 which is not associated with a MEMS sensor. Circuitry 340 in this configuration serves as an interface between MEMS sensors 310 and electrical line 320. Circuitry 340 may receive the data from the MEMS sensors and communicate the consolidated data to surface equipment 320 in some suitable format. For example, circuitry 340 may aggregate the data from the different MEMS sensors, combine the data into packets or into a time-multiplexed format, and communicate the data to the surface equipment.

Figure 3D:
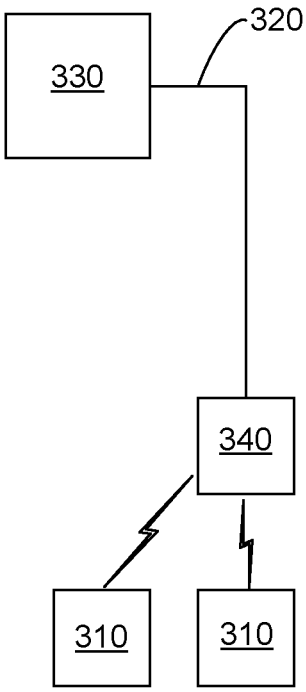

FIG. 3D depicts another alternative configuration in which MEMS sensors 310 are coupled to circuitry 340 which is not associated with a MEMS sensor. In this embodiment, each of MEMS sensors 310 is configured to wirelessly transmit data to circuitry 340, which serves as a receiver. Each of MEMS sensors 310 may be powered by a corresponding battery, or by signals generated from the sensed parameter. The use of wireless communications eliminates the need for providing wires and associated logistics for power and communication. Circuitry 340 may be positioned in a suitable location, such as at the outer diameter of the ESP component that houses MEMS sensors 310, where it can receive the wireless signals from the MEMS sensors. Circuitry 340 may then transmit the data to surface equipment 330. Circuitry 340 may also receive information from the surface equipment and wirelessly transmit the information to the MEMS sensors.

It should be noted that the general configurations of FIGS. 3A-3D are merely exemplary of the many possible configurations that may be used to communicate data between the MEMS sensors and the surface equipment.

As noted above, the MEMS sensors may be positioned in a variety of locations in the different components of the artificial lift system. FIGS. 4-7 illustrate the general structure of the components of the ESP of FIG. 1, and several possible locations of the MEMS sensors in the components.

Figure 4:
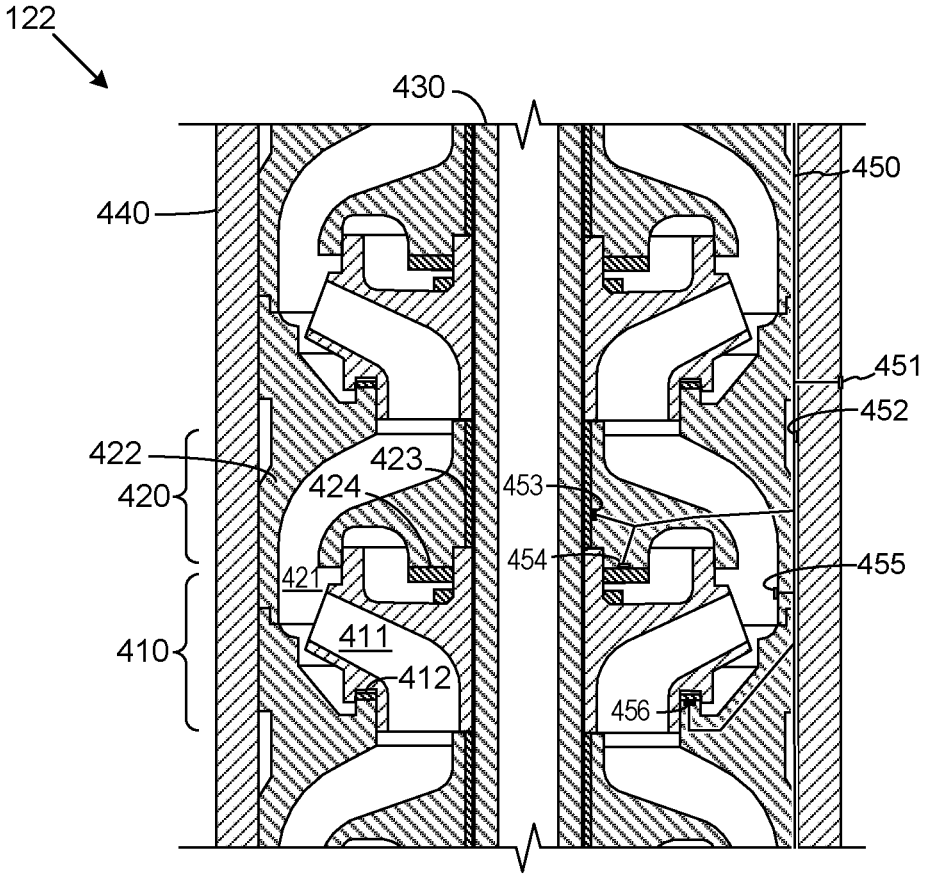
FIG. 4 is a diagram illustrating the general structure of an exemplary pump.

Referring to FIG. 4, the general structure of a pump suitable for use in an ESP as shown in FIG. 1 is illustrated. Pump 122 has multiple stages, each of which includes an impeller (e.g., 410) and a diffuser (e.g., 420). The impellers are coupled to a central shaft 430 which is coupled (in the embodiment of FIG. 1, through seal section 123 and gas separator 124) to motor 121. The motor turns shaft 430, which causes the generally radial vanes (e.g., 411) of the impellers between two diffusers to rotate within the pump housing 440. The rotation of the impellers drives fluid upward and outward toward the openings (e.g., 421) of the corresponding diffusers. The diffusers redirect the fluid upward and radially inward to convert the fluid flow to upward pressure. The fluid exiting the diffuser flows into the impeller of the next stage or, in the case of the last pump stage, exits the pump.

There may be a number of operating parameters within the pump that may be useful to operation of the system. For instance, it may be helpful to determine temperatures, pressures, vibration or the like. In the exemplary structure of FIG. 4, multiple MEMS sensors are installed in the pump to monitor several of these parameters. While these sensors are depicted as being positioned on the one of the pump stages, the sensors may be similarly positioned in multiple stages to separately monitor the corresponding parameters in each of the stages.

In the exemplary structure of FIG. 4, an electrical line 450 extends through a head of the pump and downward along the interior of housing 440. Line 450 may be routed through the pump in any suitable manner. In one embodiment, it exits housing 440 at the lower end of the pump (not shown in the figure) so that it can be externally coupled to a corresponding electrical line in gas separator 124. Alternatively, the mechanical couplings between the pump and gas separator may be designed to allow the electrical lines to extend through the couplings so that the connection between the electrical lines is internal to these components and is protected from the well environment.

Each MEMS sensors 451-456 is coupled to line 450. Sensor 451 is positioned at the exterior of housing 440 and may be configured to monitor the temperature or pressure external to the pump housing. Sensor 452 is positioned in the interstitial space between the outer wall 420 of the diffuser and pump housing 440 to monitor pressure in this space. Sensor 453 is positioned proximate to bearing 423 to monitor vibration between diffuser 420 and shaft 430. Sensor 454 is positioned proximate to thrust bearing 424 to monitor vibration between impeller 410 and diffuser 420. Sensor 455 is positioned with the diffuser cavity to monitor the pressure within diffuser 420. Sensor 456 is positioned proximate to bearing 412 to monitor vibration of impeller 410.

It should be noted that the particular number and positions of MEMS sensors depicted in the figure is intended to be illustrative, and may vary in any given embodiment. Likewise, the particular parameters that are monitored by the sensors in this example are illustrative, and in alternative embodiments may monitor other parameters.

Figure 5:
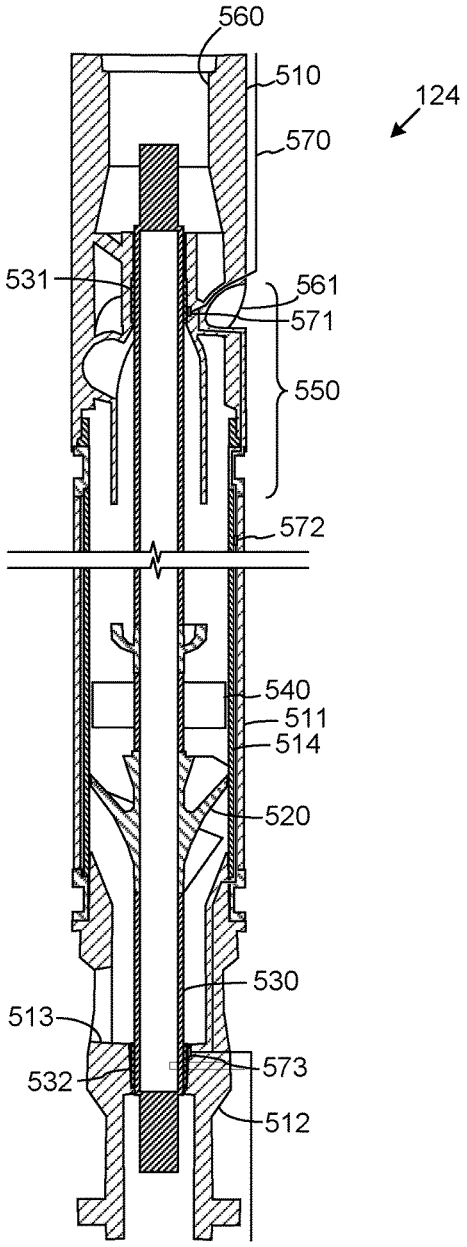
FIG. 5 is a diagram illustrating the general structure of an exemplary gas separator.

Referring to FIG. 5, the general structure of a gas separator that may be used in the system of FIG. 1 is illustrated. The gas separator is coupled to the bottom of the pump and is designed to separate gases in the well fluid from liquids. The gas is ejected from the gas separator, while the liquids are driven upward to the input of the pump. As shown in FIG. 5, gas separator 124 has a housing that includes an upper section or head (510), a middle section (511), and a lower section or base (512). Upper section 510 is configured to be coupled to the bottom of the ESP's pump. Lower section 512 is configured to be coupled to the of the seal section, which will be described in more detail below in connection with FIG. 6.

Lower housing section 512 has an opening 513 which serves as an inlet for well fluids that may include both liquids and gases. As the well fluids enter the gas separator, they flow upward toward an auger or impeller 520. Impeller 520 is coupled to a shaft 530, which is coupled to the shaft of the ESP motor. The motor rotates the shaft, which in turn rotates the impeller, forcing the well fluids upward through the gas separator. A set of vanes 540 are also coupled to shaft 530 and as the shaft rotates, it rotates the vanes the centrifugal force imparted by the vanes causes the heavier fluids (liquids such as oil) to move radially outward, while the lighter fluids (gases) move radially inward. A crossover unit 550 separates the heavier fluids which are closer to housing 511 from the lighter fluids that are closer to shaft 530. The heavier fluids flow through the crossover unit to an upper outlet 560, through which they will be provided to the ESP's pump. The lighter fluids flow through a side outlet 561 in the upper housing section, through which they exit the gas separator and flow back into the well.

Gas separator 124, like pump 122, may include multiple MEMS sensors. In the exemplary structure of FIG. 5, an electrical line 570 (which in this embodiment may be externally coupled to electrical line 450 of the pump) extends through upper housing section 510 to a MEMS sensor 571 that is positioned proximate to a radial bearing 531. Sensor 571 is configured to sense vibration at the bearing. Electrical line 570 further extends to a second MEMS sensor 572 that is positioned between middle housing section 511 and a liner 514 that is located coaxially within the middle housing section. Sensor 572 may be configured to sense temperature, pressure or various other operating parameters of the gas separator. Electrical line 570 also extends to a third MEMS sensor 572 that is positioned proximate to a lower radial bearing 532 and configured to sense vibration at the lower bearing. Additional MEMS sensors may be provided at suitable locations within the gas separator to measure other operating parameters such as fluid flow rates, fluid viscosities, etc. While electrical line 570 is depicted in the figure as extending externally to the lower end of the gas separator, it may alternatively be routed through the interior of the gas separator, where it may be more protected. It should be noted that electrical lines that are routed at the exterior of the ESP components may have protective layers (e.g., insulation, armor, etc.) to prevent damage to the lines.

Figure 6:
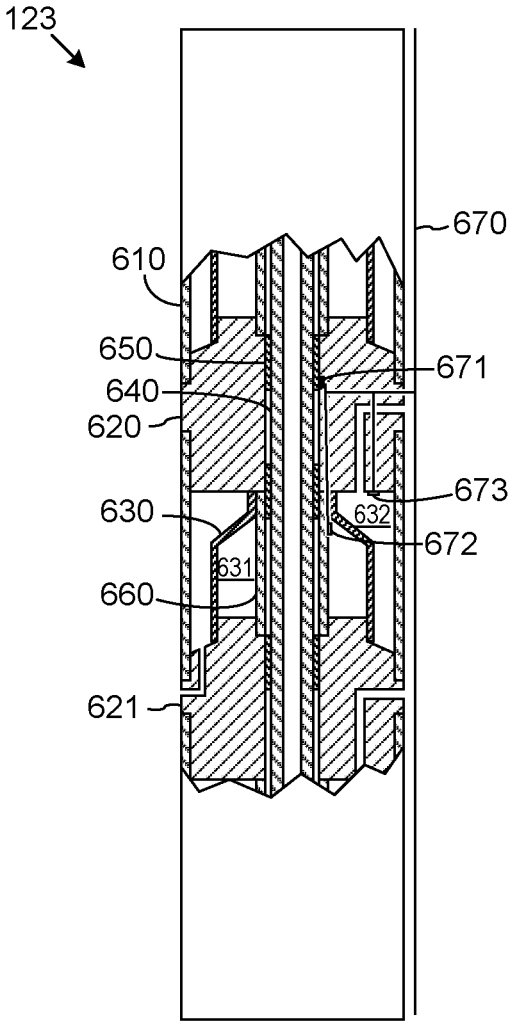
FIG. 6 is a diagram illustrating the general structure of an exemplary seal section.

Referring to FIG. 6, the general structure of a seal section that may be used in the system of FIG. 1 is illustrated. The seal section is used to equalize the pressure of the motor oil contained within the motor with the pressure of the well fluids at the exterior of the motor. The structure depicted in FIG. 6 is intended to be illustrative of the functioning of the seal section, and the specific structure may vary from one embodiment to another.

Seal section 123 has a housing 610 in which a number of bulkheads (620, 620) are positioned. The bulkheads are separated by cylindrical spacers (e.g., 660). A bore extends coaxially through the bulkheads and spacers, and a shaft 640 is positioned therein. Radial bearings (e.g., 650) are positioned between the bulkheads/spacers and the shaft. In the assembled ESP, the lower end of shaft 640 is coupled to the shaft of the motor, while the upper end of shaft 640 is coupled to the shaft of the gas separator. A flexible seal (e.g., 630) separates the volume between each bulkhead into tow expansion chambers—an oil chamber (e.g., 631) and a well fluid chamber (e.g., 632). Each of the oil chambers is interconnected by conduits in the seal section, and the well chambers are in fluid communication with the interior of the motor. Each of the well fluid chambers is in fluid communication with the exterior of the seal section. As the motor oil expands and contracts, the flexible seals (e.g., 530) flex to accommodate the change in the volume of the oil and to maintain equalization of the pressure of the oil with the pressure of the external well fluids.

Seal section 123 may include multiple MEMS sensors. As depicted in FIG. 6, an electrical line 670 extends through housing 610 and is connected to each of the sensors. Electrical line 670 in this embodiment is coupled to electrical line 570 of the gas separator, and extends to the lower end of the seal section, where it can be coupled to electrical line 760 of the ESP motor. The sensors may include, for example, vibration sensors (e.g., 671) which are positioned proximate to the radial bearings (e.g., 650) between the bulkheads and the shaft. The seal section may also include temperature and/or pressure sensors (e.g., 672) positioned within the oil chambers (e.g., 631), as well as temperature and/or pressure sensors (e.g., 673) which are positioned within the well fluid chambers (e.g., 632). It should be noted that, while only one sensor is depicted in the figure at each of these locations, the seal section may include multiple sensors which may be positioned at each of the respective bearings, chambers, etc. Sensors of these and other types may also be positioned at other locations within the seal section.

Figure 7:
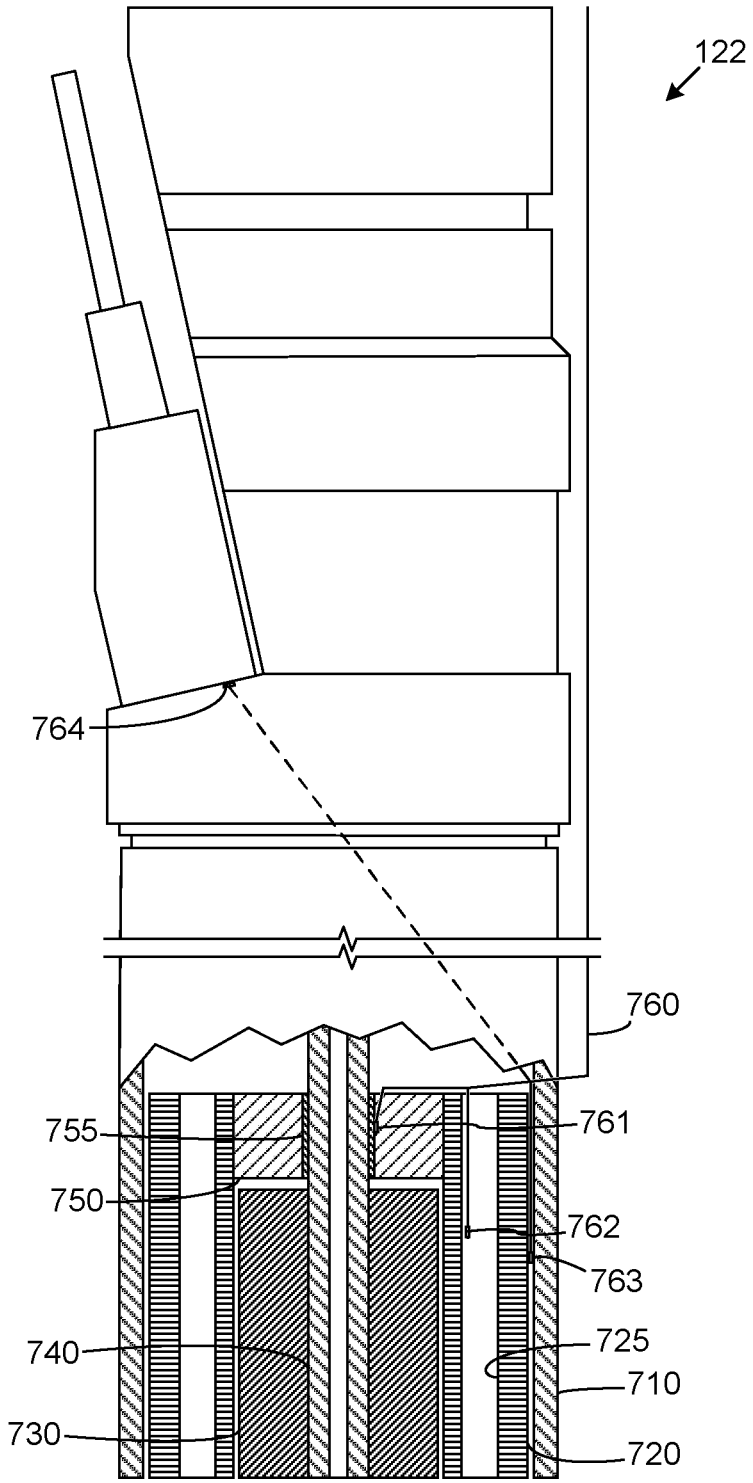
FIG. 7 is a diagram illustrating the general structure of an exemplary motor.

Referring to FIG. 7, the general structure of a motor that is suitable for use in the ESP system of FIG. 1 is illustrated. The motor receives power from an electric drive at the surface of the well and drives the interconnected shafts of each of the ESP components (seal section, gas separator and pump). The structure of the motor as shown in FIG. 7 illustrative and may vary from one embodiment to another.

FIG. 7 shows a partially cut away view of an upper end of motor 121. The motor has a housing 710 that contains a stator section 720. A rotor 730 is coaxially positioned within a bore of stator 720. Bearing carriers (e.g., 750) and bearings (e.g., 755) are positioned within the stator bore. A motor shaft 740 is positioned coxially within the stator bore and its position is maintained through contact with the bearings. Rotor 730 is secured to shaft 740. When coils of magnet wire within the slots (e.g., 725) of the stator are energized, the resulting magnetic fields interact with the rotor and cause the rotor and shaft to rotate within the stator. As indicated above, shaft 740 is coupled to the shafts of the seal section, gas separator and pump, so rotation of the motor shaft causes rotation of the respective shafts of those ESP components.

In order to monitor the operating parameters of the motor, multiple MEMS sensors may be positioned within the motor. For instance, as depicted in FIG. 7, an electrical line 760 extends through the housing 710 of the motor and is connected to a first MEMS sensor 761 that is positioned proximate to bearing 755 to monitor vibration at the bearing. Electrical line 760 is also connected to a second MEMS 762 sensor that is positioned within stator slot 725 to monitor the temperature of the coils that are located in the slot. Electrical line 760 is connected to a third MEMS sensor 763 that is positioned between stator 720 and housing 710 to monitor temperature and/or pressure within the housing. A fourth MEMS sensor 764 is connected to electrical line 760 and is positioned near the pothead connector which couples the power cable to the motor. This sensor may monitor temperature, pressure or other parameters. Still other MEMS sensors may be positioned in other locations within the motor to monitor various operating parameters at these locations.

While FIG. 7 illustrates the connection of the MEMS sensors to a separate electrical line, it should be noted that the sensors may be alternatively coupled to the surface equipment through the power cable. The communication of data between the motor and surface equipment through the power cable (a "comms-on" system) is well known and will not be described in detail. A comms-on system may utilize processing and communication circuitry to collect, process, forward or otherwise handle the data output by the MEMS sensors. The distribution of processing between the on-board circuitry of the MEMS sensors and any other preprocessing circuitry in the ESP components may vary from one embodiment to another.

It should be noted that the electrical lines illustrated in FIGS. 4-7 are depicted as dedicated lines, the electrical lines in each ESP component may be interconnected, or they may be independent of each other. As noted above, these electrical lines may be directly connected to the surface equipment, or they may be indirectly coupled to the surface equipment through, for example, a comms-on transceiver in the ESP. Further, while the foregoing description focuses on the communication of information from the MEMS sensors to the surface equipment, the system may be configured to enable the communication of information from the surface equipment to the MEMS sensors as well.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A system comprising:

an electric submersible pump (ESP) system having ESP components including at least a pump and a motor coupled to drive the pump; and a sensing system including a plurality of micro-electro-mechanical systems (MEMS) sensors coupled to the ESP system, each of the MEMS sensors having a substrate with a sensor component and on-board circuitry formed thereon, wherein the sensor component senses an operating parameter of the ESP, wherein the circuitry receives sensed information from the sensor component and provides the information at an output of the MEMS sensor;

wherein the plurality of MEMS sensors are positioned at a plurality of different locations internal to one or more of the ESP components within the ESP system;

wherein the outputs of the MEMS sensors are networked together and wherein information produced by each of the plurality of MEMS sensors is provided at a common output of the ESP system;

wherein at least a first one of the plurality of MEMS sensors is positioned internal to the one or more of the ESP components proximate to a bearing and is configured to sense vibration at the bearing;

wherein the first one of the plurality of MEMS sensors is positioned in a carrier of the bearing.

2. The system of claim 1, wherein the plurality of MEMS sensors are configured to sense two or more different types of parameters, wherein the two or more different types of parameters are selected from the group consisting of: temperature, pressure, vibration, fluid composition, viscosity and flow rate.

3. The system of claim 1, wherein at least a first one of the plurality of MEMS sensors is positioned internal to the pump to sense a parameter of the pump, and wherein at least a second one of the plurality of MEMS sensors is positioned internal to the motor to sense a parameter of the motor.

4. The system of claim 1, wherein the ESP system further comprises at least one additional ESP component comprising either a seal section or a gas separator, wherein at least a third one of the plurality of MEMS sensors is positioned in the at least one additional ESP component to sense a parameter of the at least one additional ESP component.

5. A system comprising:

an electric submersible pump (ESP) system having ESP components including at least a pump and a motor coupled to drive the pump; and a sensing system including a plurality of micro-electro-mechanical systems (MEMS) sensors coupled to the ESP system, each of the MEMS sensors having a substrate with a sensor component and on-board circuitry formed thereon, wherein the sensor component senses an operating parameter of the ESP, wherein the circuitry receives sensed information from the sensor component and provides the information at an output of the MEMS sensor;

wherein the plurality of MEMS sensors are positioned at a plurality of different locations internal to one or more of the ESP components within the ESP system;

wherein the outputs of the MEMS sensors are networked together and wherein information produced by each of the plurality of MEMS sensors is provided at a common output of the ESP system;

wherein at least a first one of the plurality of MEMS sensors is positioned internal to the one or more of the ESP components proximate to a bearing and is configured to sense vibration at the bearing:

wherein the first one of the plurality of MEMS sensors is positioned in contact with the bearing.

6. The system of claim 5, wherein the plurality of MEMS sensors are configured to sense two or more different types of parameters, wherein the two or more different types of parameters are selected from the group consisting of: temperature, pressure, vibration, fluid composition, viscosity and flow rate.

7. The system of claim 5, wherein at least a first one of the plurality of MEMS sensors is positioned internal to the pump to sense a parameter of the pump, and wherein at least a second one of the plurality of MEMS sensors is positioned internal to the motor to sense a parameter of the motor.

8. The system of claim 5, wherein the ESP system further comprises at least one additional ESP component comprising either a seal section or a gas separator, wherein at least a third one of the plurality of MEMS sensors is positioned in the at least one additional ESP component to sense a parameter of the at least one additional ESP component.

9. A system comprising:

an electric submersible pump (ESP) system having ESP components including at least a pump and a motor coupled to drive the pump; and a sensing system including a plurality of micro-electro-mechanical systems (MEMS) sensors coupled to the ESP system, each of the MEMS sensors having a substrate with a sensor component and on-board circuitry formed thereon, wherein the sensor component senses an operating parameter of the ESP, wherein the circuitry receives sensed information from the sensor component and provides the information at an output of the MEMS sensor;

wherein the plurality of MEMS sensors are positioned at a plurality of different locations internal to one or more of the ESP components within the ESP system;

wherein the outputs of the MEMS sensors are networked together and wherein information produced by each of the plurality of MEMS sensors is provided at a common output of the ESP system;

wherein at least a first one of the plurality of MEMS sensors is positioned in a diffuser cavity within the pump and is configured to sense pressure within the diffuser cavity.

10. The system of claim 9, wherein the plurality of MEMS sensors are configured to sense two or more different types of parameters, wherein the two or more different types of parameters are selected from the group consisting of: temperature, pressure, vibration, fluid composition, viscosity and flow rate.

11. The system of claim 9, wherein at least a first one of the plurality of MEMS sensors is positioned internal to the pump to sense a parameter of the pump, and wherein at least a second one of the plurality of MEMS sensors is positioned internal to the motor to sense a parameter of the motor.

12. The system of claim 9, wherein the ESP system further comprises at least one additional ESP component comprising either a seal section or a gas separator, wherein at least a third one of the plurality of MEMS sensors is positioned in the at least one additional ESP component to sense a parameter of the at least one additional ESP component.

13. A system comprising:

an electric submersible pump (ESP) system having ESP components including at least a pump and a motor coupled to drive the pump; and a sensing system including a plurality of micro-electro-mechanical systems (MEMS) sensors coupled to the ESP system, each of the MEMS sensors having a substrate with a sensor component and on-board circuitry formed thereon, wherein the sensor component senses an operating parameter of the ESP, wherein the circuitry receives sensed information from the sensor component and provides the information at an output of the MEMS sensor;

wherein the plurality of MEMS sensors are positioned at a plurality of different locations internal to one or more of the ESP components within the ESP system;

wherein the outputs of the MEMS sensors are networked together and wherein information produced by each of the plurality of MEMS sensors is provided at a common output of the ESP system;

wherein at least a first one of the plurality of MEMS sensors is positioned in an oil chamber of a seal section of the ESP and is configured to sense pressure within the oil chamber.

14. The system of claim 13, wherein the plurality of MEMS sensors are configured to sense two or more different types of parameters, wherein the two or more different types of parameters are selected from the group consisting of: temperature, pressure, vibration, fluid composition, viscosity and flow rate.

15. The system of claim 13, wherein at least a first one of the plurality of MEMS sensors is positioned internal to the pump to sense a parameter of the pump, and wherein at least a second one of the plurality of MEMS sensors is positioned internal to the motor to sense a parameter of the motor.

16. The system of claim 13, wherein the ESP system further comprises at least one additional ESP component comprising either a seal section or a gas separator, wherein at least a third one of the plurality of MEMS sensors is positioned in the at least one additional ESP component to sense a parameter of the at least one additional ESP component.

17. A system comprising:

an electric submersible pump (ESP) system having ESP components including at least a pump and a motor coupled to drive the pump; and a sensing system including a plurality of micro-electro-mechanical systems (MEMS) sensors coupled to the ESP system, each of the MEMS sensors having a substrate with a sensor component and on-board circuitry formed thereon, wherein the sensor component senses an operating parameter of the ESP, wherein the circuitry receives sensed information from the sensor component and provides the information at an output of the MEMS sensor;

wherein the plurality of MEMS sensors are positioned at a plurality of different locations internal to one or more of the ESP components within the ESP system;

wherein the outputs of the MEMS sensors are networked together and wherein information produced by each of the plurality of MEMS sensors is provided at a common output of the ESP system;

wherein at least a first one of the plurality of MEMS sensors is positioned within the pump in an interstitial space between an outer wall of a pump diffuser and a pump housing and is configured to sense pressure within the interstitial space.

18. The system of claim 17, wherein the plurality of MEMS sensors are configured to sense two or more different types of parameters, wherein the two or more different types of parameters are selected from the group consisting of: temperature, pressure, vibration, fluid composition, viscosity and flow rate.

19. The system of claim 17, wherein at least a first one of the plurality of MEMS sensors is positioned internal to the pump to sense a parameter of the pump, and wherein at least a second one of the plurality of MEMS sensors is positioned internal to the motor to sense a parameter of the motor.

20. The system of claim 17, wherein the ESP system further comprises at least one additional ESP component comprising either a seal section or a gas separator, wherein at least a third one of the plurality of MEMS sensors is positioned in the at least one additional ESP component to sense a parameter of the at least one additional ESP component.

* * * * *